US010791901B2

(12) United States Patent
Moon et al.

(10) Patent No.: US 10,791,901 B2
(45) Date of Patent: Oct. 6, 2020

(54) CLEANER

(71) Applicant: LG ELECTRONICS INC., Seoul (KR)

(72) Inventors: Byungryul Moon, Seoul (KR); Jiwoong Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 497 days.

(21) Appl. No.: 15/567,307

(22) PCT Filed: May 3, 2016

(86) PCT No.: PCT/KR2016/004642
§ 371 (c)(1),
(2) Date: Oct. 17, 2017

(87) PCT Pub. No.: WO2016/190561
PCT Pub. Date: Dec. 1, 2016

(65) Prior Publication Data

US 2018/0103816 A1 Apr. 19, 2018

(30) Foreign Application Priority Data

May 26, 2015 (KR) ..... 10-2015-0072922

(51) Int. Cl.
*A47L 9/28* (2006.01)
*A47L 11/40* (2006.01)

(52) U.S. Cl.
CPC ..... *A47L 9/2868* (2013.01); *A47L 9/28* (2013.01); *A47L 9/2842* (2013.01); *A47L 9/2857* (2013.01); *A47L 11/40* (2013.01)

(58) Field of Classification Search
CPC .... A47L 9/2868; A47L 9/2842; A47L 9/2857; A47L 11/40; A47L 1/00; A47L 3/00;
(Continued)

(56) References Cited

U.S. PATENT DOCUMENTS 6,301,743 B1 * 10/2001 Cloud ..... A47L 9/2842 15/339
7,131,164 B2 * 11/2006 Uratani ..... A47L 9/02 15/328
7,309,365 B2 * 12/2007 Yuasa ..... A47L 9/20 15/21.1

FOREIGN PATENT DOCUMENTS

JP H10-211142 8/1998
JP 2000-116582 4/2000
(Continued)

OTHER PUBLICATIONS

International Search Report (with English Translation) and Written Opinion dated Aug. 12, 2016 issued in Application No. PCT/KR2016/004642.

(Continued)

*Primary Examiner* — Antony M Paul
(74) *Attorney, Agent, or Firm* — KED & Associates, LLP

(57) ABSTRACT

A cleaner according to one aspect of the present invention comprises: a power input unit; a controller; a power consumption unit controlled by the controller; an operation unit for inputting a command for controlling an operating state of the power consumption unit; and a power supply control unit connected to the power input unit, the controller, and the operation unit, wherein the power supply control unit enables the power inputted from the power input unit to be supplied to the controller and transmits a signal for the intensity of a suction force to the controller when the intensity of the suction force is selected by the operation unit, and prevents the power inputted from the power input unit from being supplied to the controller when an off command is inputted by the operation unit.

14 Claims, 5 Drawing Sheets

(58) Field of Classification Search
CPC ..... A47L 5/00; A47L 7/00; A47L 9/00; A47L 11/00; A47L 13/00; A47L 25/00; H02P 1/00; H02P 1/26; H02P 1/46; H02P 3/00; H02P 3/16; H02P 3/18; H02P 6/00; H02P 6/14; H02P 7/00; H02P 8/00; H02P 21/00; H02P 23/00; H02P 25/00; H02P 27/00; H02P 27/04; H02P 27/06
USPC ..... 318/400.01, 400.02, 700, 701, 721, 799, 318/800, 801, 430, 432; 15/246.2
See application file for complete search history.

(56) References Cited

FOREIGN PATENT DOCUMENTS

| | | | | |
|---|---|---|---|---|
| JP | 2010-148827 | | 7/2010 | |
| JP | 2014-108301 | | 6/2014 | |
| JP | 2014108301 A | * | 6/2014 | ..... A47L 9/28 |
| JP | 2014-136013 | | 7/2014 | |
| KR | 10-2007-0057530 | | 6/2007 | |
| KR | 10-1125291 | | 3/2012 | |
| KR | 10-1134183 | | 4/2012 | |
| WO | WO-2014112399 A1 | * | 7/2014 | ..... H02J 7/007192 |

OTHER PUBLICATIONS

European Search Report dated Nov. 13, 2018 issued in Application No. 16800201.2.
Korean Office Action dated Nov. 30, 2018 issued in Application No. 10-2015-0072922.

* cited by examiner

CLEANER

CROSS-REFERENCE TO RELATED PATENT APPLICATIONS

This application is a U.S. National Stage Application under 35 U.S.C. § 371 of PCT Application No. PCT/KR2016/004642, filed May 3, 2016, which claims priority to Korean Patent Application No. 10-2015-0072922, filed May 26, 2015, whose entire disclosures are hereby incorporated by reference.

TECHNICAL FIELD

The present invention relates to a cleaner.

BACKGROUND ART

A vacuum cleaner refers to a device for sucking in air including dust using suction force generated by a suction motor mounted in a main body thereof and filtering out dust in the main body.

As the related art, Korean Registered Patent Publication No. 1125291 (registration date: Mar. 2, 2012) discloses a steam cleaner.

In a steam cleaner, when a user sensing unit does not sense a user while power is supplied to a main body of the cleaner and a heater of a nozzle, supply of power is interrupted in order to decrease unnecessary power consumption.

However, in the steam cleaner disclosed in the related art, since the user sensing unit for stopping supply of power operates only during operation, standby power is continuously consumed when operation of the steam cleaner is interrupted but a power cord is plugged into a socket.

Of course, an ON/OFF switch may be further included in order to reduce standby power consumption. However, in this case, a structure may be complicated and, when the cleaner is manipulated in a state in which the user turns the ON/OFF switch off, the cleaner does not operate and thus the user may misrecognize that the cleaner breaks down.

DISCLOSURE

Technical Problem

An object of the present invention is to provide a cleaner for preventing standby power consumption using a simple structure.

Technical Solution

The object of the present invention can be achieved by providing a cleaner including a power input unit for receiving and outputting power, a controller for selectively receiving power from the power input unit, a power consumption unit controlled by the controller, a manipulation unit for inputting a command for adjusting an operation state of the power consumption unit, and a power supply adjuster connected to the power input unit, the controller and the manipulation unit, wherein the power supply adjuster supplies power received from the power input unit to the controller and transmits a signal for the intensity of the suction force to the controller, in a state in which an intensity of suction force is selected by the manipulation unit, and interrupts supply of power received from the power input unit to the controller in a state in which an OFF command is input by the manipulation unit.

Any one of selection of the intensity of the suction force and input of the OFF command may be selectively performed in the manipulation unit.

The power supply adjuster may include a power switch connected to the power input unit and the manipulation unit.

The power supply adjuster may include a first resistor connected to a first terminal and control terminal of the power switch and a second resistor connected to the control terminal of the power switch and one end of the manipulation unit.

The manipulation unit may include a sliding member operating in a sliding manner, and the power switch may be maintained in an OFF state when the sliding member is moved to an OFF position and may be maintained in an ON state when the sliding member is moved to an ON position.

The cleaner may further include a switch mode power supply (SMPS) connected to a second terminal of the power switch and the controller to supply a driving voltage to the controller.

The cleaner may further include a switch mode power supply (SMPS) connected to the first terminal of the power switch and the power input unit to supply a driving voltage to the controller.

The manipulation unit may include an OFF button, a selection button for inputting an operation command of the power consumption unit, and a tact switch capable of being turned on by selection of the OFF button and the selection button.

The cleaner may further include a protection circuit for maintaining the power switch in an ON state in a state of selecting the selection button.

The protection circuit may include a resistor connected to the control terminal of the power switch and a switch connected to the resistor and controlled by the controller.

The resistor of the protection circuit may be connected to the second resistor in parallel.

The power supply adjuster may include a third resistor connected to the other end of the manipulation unit and a fourth resistor connected to the third resistor in series and grounded, and the controller may be connected between the third resistor and the fourth resistor.

The power input unit may be a power cord connected to a commercial power supply.

The power input unit may be a battery capable of supplying power to the power consumption unit.

Advantageous Effects

According to the invention, since supply of power to a controller is interrupted by a power supply adjuster in a state in which operation of a cleaner is stopped, it is possible to prevent standby power consumption due to ON of the controller.

In the present invention, when a sliding member is located at an OFF position, since supply of power to the controller is interrupted without using a separate mechanical switch manipulated by a user, a structure is simple and the cleaner is prevented from not operating when the user manipulates a manipulation unit in order to use the cleaner. That is, by adding a power supply adjuster 52 without mechanical change of the cleaner, it is possible to prevent standby power consumption.

Further, if the power input unit is a battery, the battery can be prevented from being discharged due to standby power consumption of the controller. That is, if standby power consumption is not prevented in a state in which the battery is fully charged, the battery may be discharged by standby power consumption after a predetermined time.

In this case, if the user recognizes that the battery is fully charged and operates the cleaner but the cleaner does not operate, the user may misrecognize that the cleaner breaks down and recharge the battery.

However, according to the present invention, since standby power consumption is prevented in a state in which the cleaner is turned off, the state in which the battery is fully charged can be maintained.

BEST MODE

Figure 1:
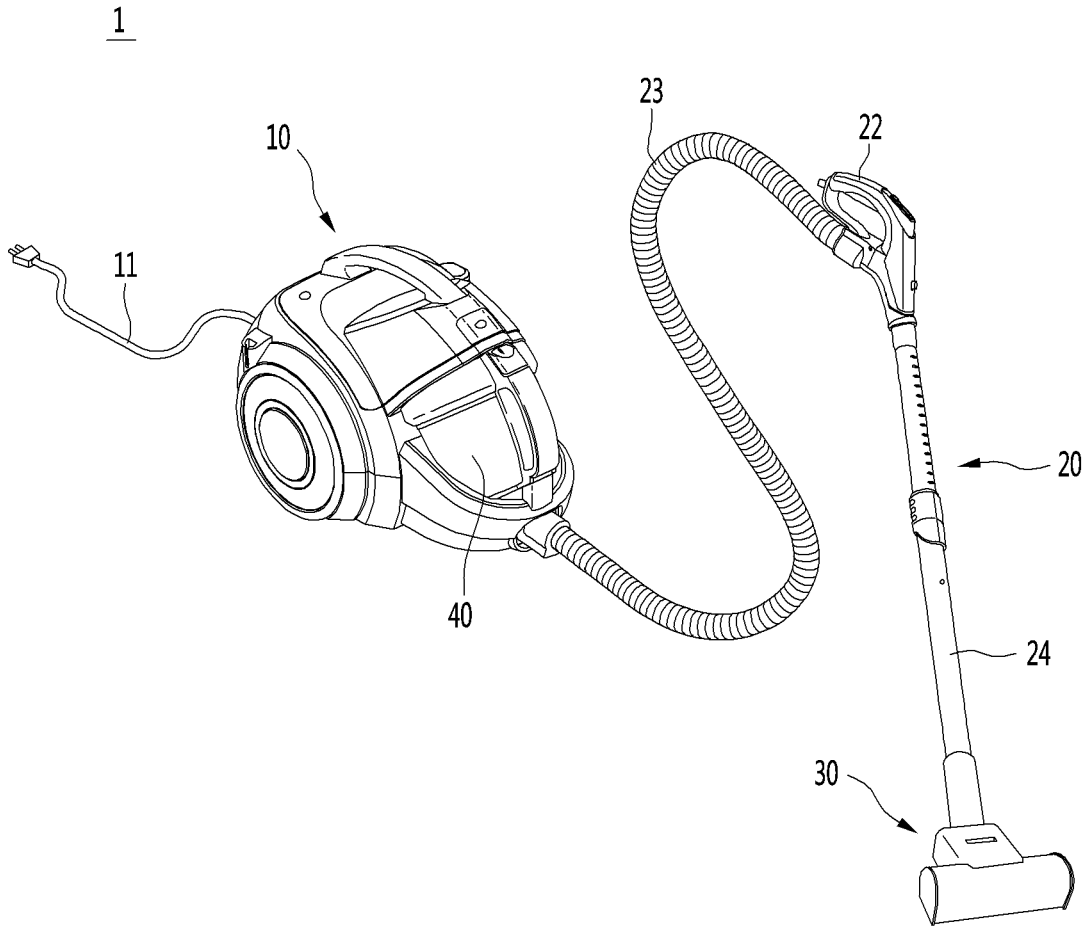
FIG. 1 is a perspective view of a cleaner according to a first embodiment.

Hereinafter, embodiments of the present invention will be described in detail with reference to the drawings. It is noted that the same reference numerals designate the same constituent elements throughout the description of the drawings. In describing the present invention, if it is determined that the detailed description of a related known function or construction renders the scope of the present invention unnecessarily ambiguous, the detailed description thereof will be omitted.

It will be understood that, although the terms first, second, A, B, (a), (b), etc. may be used herein to describe various elements of the present invention, these terms are only used to distinguish one element from another element and essential, order, or sequence of corresponding elements are not limited by these terms. It will be understood that when one element is referred to as being "connected to", "coupled to", or "linked to" another element, one element may be "connected to", "coupled to", or "linked to" another element via a further element although one element may be directly connected to or directly linked to another element.

Figure 2:
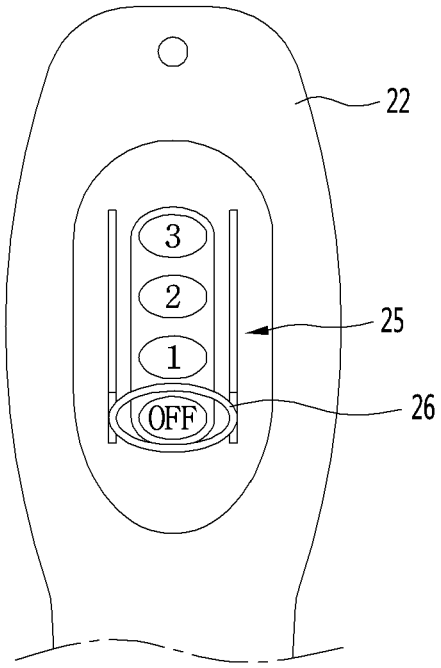
FIG. 2 is a perspective view of a handle according to a first embodiment.

FIG. 1 is a perspective view of a cleaner according to a first embodiment, and FIG. 2 is a perspective view of a handle according to a first embodiment.

Referring to FIGS. 1 and 2, the cleaner according to the first embodiment may include a main body 10 and a suction device 20 connected to the main body 10.

The suction device 20 may include a suction part 21 for sucking in dust on a cleaning surface, e.g., a floor surface and connectors 22, 23 and 24 for connecting the suction part 21 to the main body 10.

The connectors 22, 23 and 24 may include an extension pipe 24 connected to the suction part 21, a handle 22 connected to the extension pipe 24 and a suction hose 23 for connecting the handle 22 to the main body 10.

The vacuum cleaner 1 may further include a dust separator (not shown) for separating air and dust sucked in by the suction device 20 and a dust canister 40 for storing dust separated by the dust separator. The dust canister 40 may be detachably mounted in the main body 10. The dust separator may be formed integrally with or separately from the dust canister 40.

Although a canister type cleaner is shown in FIG. 1, the present invention is not limited thereto and is applicable to an upright type cleaner in which a main body 10 is rotatably connected to a suction part 21 or a stick type cleaner, to which supply of standby power needs to be interrupted.

The handle 22 may include a manipulation unit 25 for selecting power on/off of the cleaner 1 and inputting a command for adjusting the operation state of the cleaner 1.

In the manipulation unit 25, any one of selection of the intensity of suction force of the cleaner 1 or input of an OFF command of the cleaner 1 may be selectively performed.

The manipulation unit 25 may include a sliding member 26 slidably provided in the handle 22 and a variable resistor part (not shown) for changing resistance according to the position of the sliding member 26, for example.

By sliding operation of the sliding member 26, the cleaner 1 may be turned off or may be turned on while adjusting the operation state of the cleaner 1. The resistance value of the variable resistor part may be 0 if the sliding member 26 is located at an OFF position and may be greater than 0 if the sliding member 26 is located at an ON position (a position other than the OFF position) (any one of numerals 1, 2 and 3 of FIG. 2).

By sliding operation of the sliding member 26, only any one of adjustment of the intensity of suction force of the cleaner 1 or the OFF command of the cleaner 1 may be selectively received.

Alternatively, the resistance value of the variable resistor part may be a first resistance value greater than 0 if the sliding member 26 is located at an OFF position and may be greater than the first resistance value if the sliding member 26 is located at an ON position.

Since the manipulation unit 25 may be implemented by the well-known technology, a detailed description thereof will be omitted in the present invention.

Figure 3:
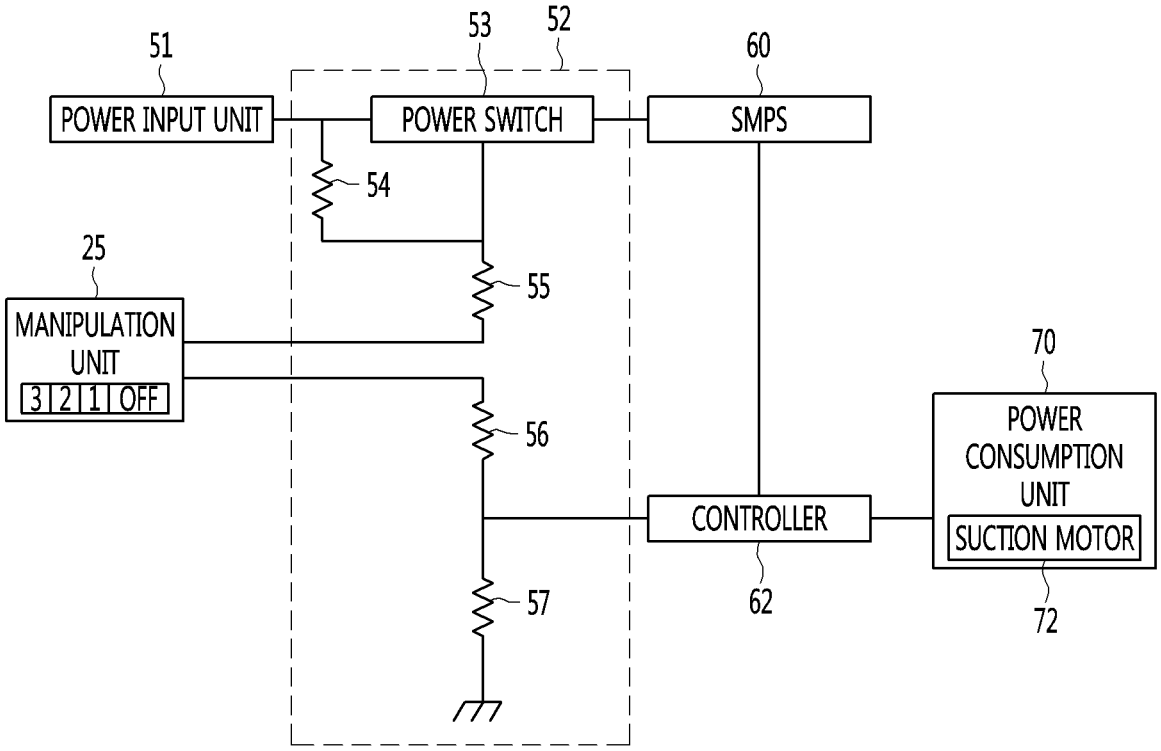
FIG. 3 is a block diagram of a cleaner according to a first embodiment.

The main body 10 may include a suction motor (see 72 of FIG. 3) and adjustment of the operation state of the cleaner 1 may include adjustment of the intensity of suction force according to operation of the suction motor (see 72 of FIG. 3). By selecting the intensity of suction force using the manipulation unit 25, the intensity of the suction motor (see 72 of FIG. 3) may be variously adjusted. That is, after the sliding member 26 is moved to the ON position, the intensity of suction force may be determined according to the position of the sliding member.

FIG. 3 is a block diagram of a cleaner according to a first embodiment.

Referring to FIGS. 1 to 3, the cleaner 1 according to the first embodiment may include a power input unit 51 for receiving and outputting power, a power consumption unit 70 operating upon selectively receiving power from the power input unit 51, and a controller 62 for controlling the power consumption unit 70.

The controller 62 may also selectively receive power from the power input unit 51.

The power input unit 51 may be a power cord 11 connected to a commercial power supply or a battery (not shown) provided in the main body 10 to supply power to the power consumption unit 70.

The power consumption unit 70 may include the suction motor 72. Of course, the power consumption unit 70 may include various elements for consuming power, which are changed according to cleaner type, such as a display unit, a notification unit, an additional motor or a heater.

The cleaner 1 may further include a power supply adjuster 52 for adjusting supply of power.

The power supply adjuster 52 may be connected to the power input unit 51 and the manipulation unit 25.

The power supply adjuster 52 may interrupt supply of power received from the power input unit 51 to the controller 62 when the sliding member 26 is moved to the OFF position and supply power received from the power input unit to the controller 62 when the sliding member 26 is moved to the ON position.

In addition, the power supply adjuster 56 may transmit a signal for the intensity of suction force selected by the manipulation unit 25 to the controller 62.

That is, according to the present invention, the manipulation unit 25 may not be directly connected to the controller 62 but may be connected to one end of the controller 62 through the power supply adjuster 52, such that supply of power to the controller 62 is interrupted when the sliding member 26 is moved to the OFF position, thereby preventing standby power consumption.

The power supply adjuster 52 may include a power switch 53. The power switch 53 may include, but limited thereto, a field effect transistor (FET) or a bipolar junction transistor (BJT), etc.

At this time, the power input unit 51 may be connected to a first terminal of the power switch 53 and the manipulation unit 25 may be connected to a control terminal of the power switch 53.

The power supply adjuster 52 may further include a first resistor 54 and a second resistor 55.

The second resistor 52 may be connected to one end of the manipulation unit 25 and the control terminal of the power switch 53. The first resistor 51 may be connected to the first terminal and control terminal of the power switch 53.

As the manipulation unit 25 is connected to the control terminal of the power switch 53 and the first resistor 54 and the second resistor 55 are present, the voltages applied to the first terminal and control terminal of the power switch 53 become equal in a state in which the sliding member 26 is moved to the OFF position, thereby maintaining the power switch 53 in the OFF state.

In a state in which the sliding member 26 is moved to the ON position, the voltage applied to the control terminal may become less than the voltage applied to the first terminal of the power switch 53, thereby turning the power switch 53 on.

Of course, in a state in which the sliding member 26 is moved to the OFF position, the second resistor 55 may be omitted according to the size of the resistor of the variable resistor part and the size of the first resistor 54.

That is, the power switch 53 may be turned on or off by manipulation of the manipulation unit 25.

The power supply adjuster 52 may further include a third resistor 56 and a fourth resistor 57. The third resistor 56 may be connected to the other end of the manipulation unit 25 and the fourth resistor 57 may be connected to the third resistor 56 in series and grounded. The third resistor 56 and the fourth resistor 57 are distribution resistors for delivering the manipulation signal of the manipulation unit 25 to the controller 62.

One end of the controller 62 may be connected between the third resistor 56 and the fourth resistor 57.

The cleaner 1 may further include a switch mode power supply (SMPS) 60 for supplying a driving voltage to the controller 62 when the power switch 53 is turned on. In addition, the SMPS may generate the driving voltage for driving the power consumption unit 70.

The SMPS 60 may be connected to a second terminal of the power switch 53 and the other end of the controller 62.

According to the present embodiment, when the power switch 53 is turned on, the driving voltage is applied to the controller 62 to turn the controller 62 on.

When the controller 62 is turned on, the controller 62 may receive the manipulation signal from the manipulation unit 25 and control operation of the power consumption unit 70 based on the received manipulation signal.

According to the present invention, in a state in which operation of the cleaner 1 is stopped, supply of power to the controller 62 is interrupted by the power supply adjuster 53, thereby preventing standby power consumption due to ON of the controller 62.

In addition, in the present invention, when a sliding member is located at an OFF position, since supply of power to the controller 62 is interrupted without using a separate mechanical switch manipulated by a user, a simple structure can be implemented and the cleaner is prevented from not operating when the user manipulates the manipulation unit in order to use the cleaner. That is, the power supply adjuster 52 is added without mechanical change of the cleaner, thereby preventing standby power consumption.

Further, if the power input unit 51 is a battery, the battery can be prevented from being discharged due to standby power consumption of the controller 61. That is, if standby power consumption is not prevented in a state in which the battery is fully charged, the battery may be discharged due to standby power consumption after a predetermined time.

In this case, when the user recognizes that the battery is fully charged and operates the cleaner but the cleaner does not operate, the user may misrecognize that the cleaner breaks down. In addition, the user may troublesomely recharge the battery.

However, according to the present invention, since standby power consumption is prevented in a state in which operation of the cleaner is stopped, the state in which the battery is fully charged can be maintained.

Figure 4:
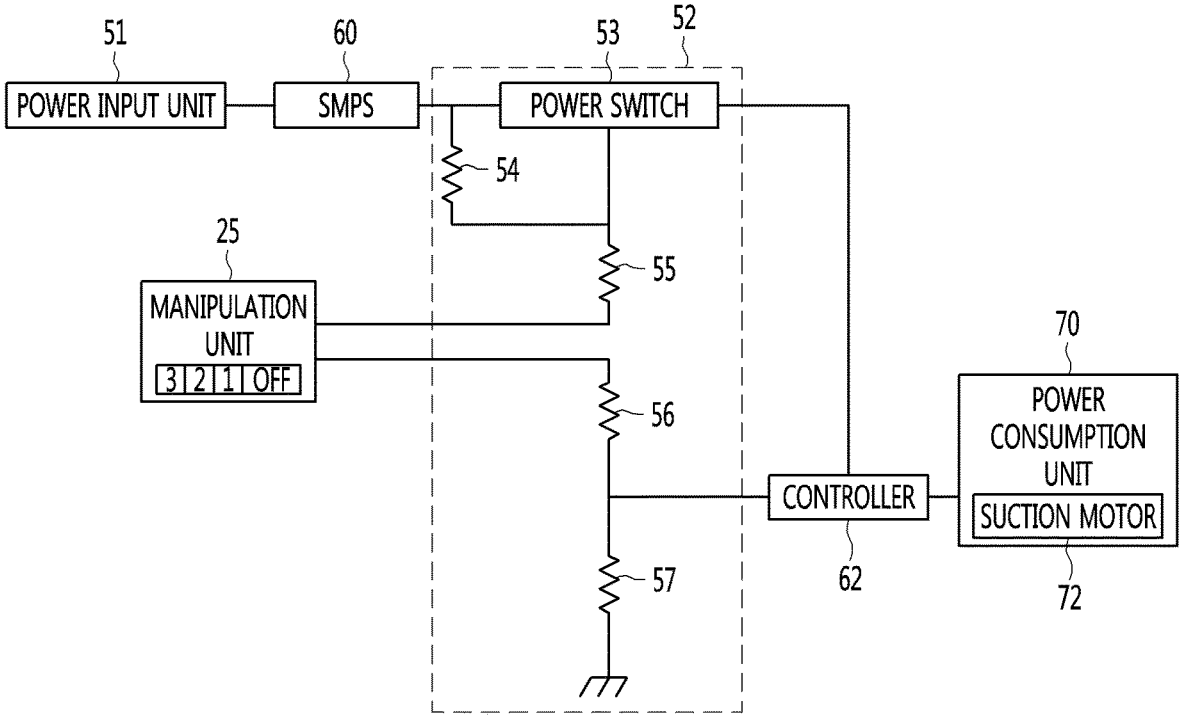
FIG. 4 is a block diagram of a cleaner according to a second embodiment.

FIG. 4 is a block diagram of a cleaner according to a second embodiment.

This embodiment is equal to the first embodiment except for the position of the SMPS. Accordingly, only the features of this embodiment will be described. For the same portions as the first embodiment, refer to the description of the first embodiment.

Referring to FIG. 4, the SMPS 60 of this embodiment may be connected to the first terminal of the power switch 53 and the power input unit 51. The manipulation unit 25 may be connected to the control terminal of the power switch 53.

Even in this embodiment, when the sliding member 25 is moved to the OFF position, the power switch 53 may be maintained in the OFF state.

In a state in which the sliding member 26 is moved to the OFF position, the voltages applied to the first terminal and control terminal of the power switch 53 become equal, thereby maintaining the power switch 53 in the OFF state.

In a state in which the sliding member 26 is moved to the ON position, the voltage applied to the control terminal becomes less than the voltage applied to the first terminal of the power switch 53, thereby turning the power switch 53 on. Then, power is received from the power input unit 51 to supply the driving voltage generated by the SMPS 60 to the controller 62, thereby turning the controller 62 on.

When the controller 62 is turned on, the controller 62 may receive a manipulation signal from the manipulation unit 25 and control operation of the power consumption unit 70 based on the received manipulation signal.

Figure 5:
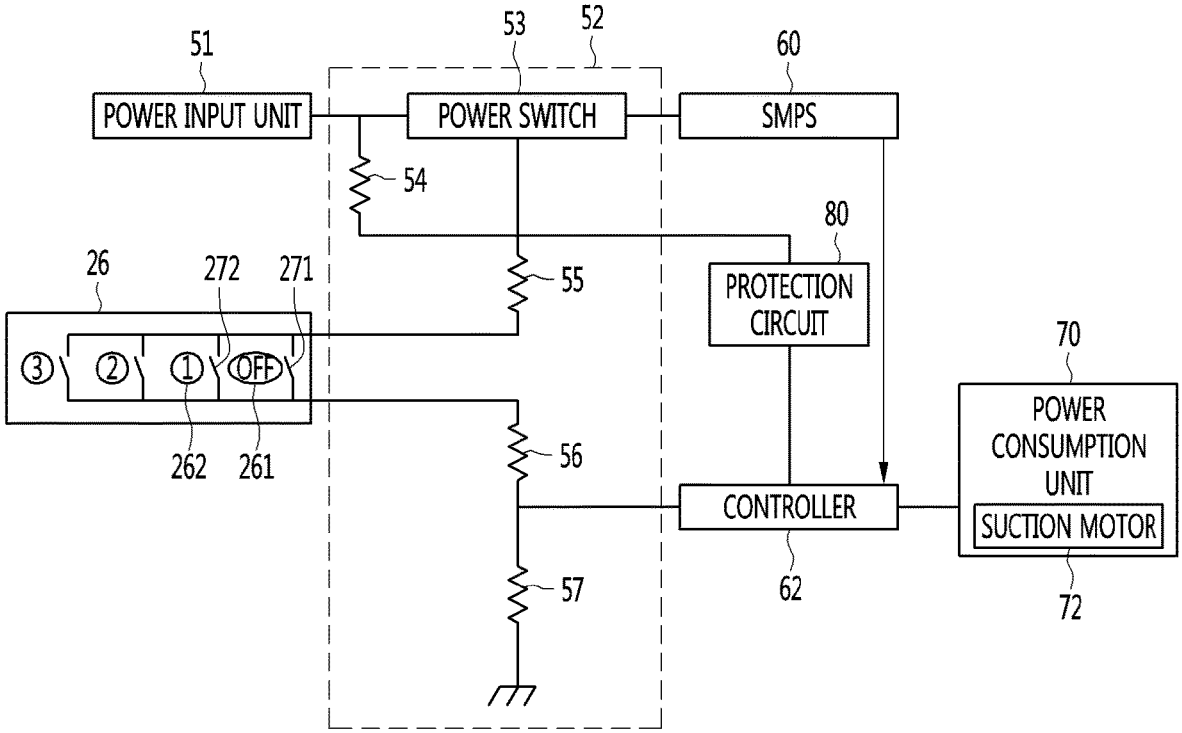
FIG. 5 is a block diagram showing a cleaner according to a third embodiment.

FIG. 5 is a block diagram showing a cleaner according to a third embodiment.

This embodiment is equal to the first embodiment except for the type of the manipulation unit and provision of a protection circuit. Accordingly, only the features of this embodiment will be described. For the same portions as the first embodiment, refer to the description of the first embodiment.

Referring to FIG. 5, the manipulation unit 26 of this embodiment may include an OFF button 261 for selecting OFF, one or more selection buttons 262 for inputting operation commands of the power consumption unit 70 and a plurality of tact switches 271 and 272 capable of being turned on by pressing the buttons 261 and 262.

The plurality of tact switches 271 and 272 is turned on only when the buttons 261 and 262 are pressed.

Accordingly, when the buttons 261 and 262 are pressed, the tact switches 271 and 272 are turned on and, when pressing of the buttons 261 and 262 is released, the plurality of tact switches 271 and 272 is turned off.

In a state in which the cleaner 1 is turned off, the plurality of tact switches 271 and 272 are turned off.

In this state, the voltages applied to the first terminal and control terminal of the power switch 53 become equal, thereby maintaining the power switch 53 in the OFF state.

When the selection button 262 is pressed by the user, the tact switch 272 corresponding to the pressed selection button 262 may be turned on. When the tact switch 272 is turned on, the voltage applied to the control terminal becomes less than the voltage applied to the first terminal of the power switch 53, thereby turning the power switch 53 on.

When the power switch 53 is turned on, the driving voltage is applied to the controller 62, thereby turning the controller 62 on.

When the controller 62 is turned on, the controller 62 may receive the manipulation signal corresponding to the turned-on tact switch 272 and control operation of the power consumption unit 70 based on the received manipulation signal.

At this time, the selection button 262 may not be continuously pressed by the user and pressing of the selection button 262 may be released after being pressed for a predetermined time. In this case, the tact switch 272 corresponding to the selection button 262 is turned off. When the tact switch 272 corresponding to the selection button 262 is turned off, the power switch 53 is turned off. In this case, operation of the cleaner 1 may be unintentionally stopped during operation of the cleaner 1.

Accordingly, the cleaner 1 of this embodiment may further include a protection circuit 80 for maintaining the ON state after the cleaner 1 is turned on.

The protection circuit 80 and the second resistor 55 may be connected to the control terminal of the power switch 53 in parallel.

The protection circuit 80 may include a resistor connected to the control terminal of the power switch 53 and the controller 62 and a switch connected to the resistor and controlled by the controller 62.

When the controller 62 is turned on, the controller 62 may turn the switch of the protection circuit 80 on. When the switch of the protection circuit 80 is turned on, although the tact switch 272 corresponding to the selection button 62 is turned off, since the power switch 53 is connected to the protection circuit 80, the power switch 53 may be on. That is, even when the tact switch 272 is turned off, the resistor of the protection circuit 80 is connected to the control terminal of the power switch 53 and the voltage applied to the control terminal is less than the voltage applied to the first terminal of the power switch 53, thereby maintaining the power switch 53 in the ON state.

Of course, when the OFF button 262 is selected, the controller 62 may turn the switch of the protection circuit 80 off.

Although all elements constituting the embodiments of the present invention are described to be integrated into a single one or to be operated as a single one, the present invention is not necessarily limited to such embodiments. That is, all of the elements may be selectively integrated into one or more and be operated as one or more within the object and the scope of the present invention. The term "comprises", "includes", or "has" described herein should be interpreted not to exclude other elements but to further include such other elements since the corresponding elements may be inherent unless mentioned otherwise. All terms including technical or scientific terms have the same meanings as generally understood by a person having ordinary skill in the art to which the present invention pertains unless mentioned otherwise. Generally used terms, such as terms defined in a dictionary, should be interpreted to coincide with meanings of the related art from the context. Unless obviously defined in the present invention, such terms are not interpreted as ideal or excessively formal meanings.

The above description is only to describe the technical spirit of the present invention. Those skilled in the art will appreciate that various modifications and applications are possible, without departing from the scope and spirit of the invention as disclosed in the accompanying claims. The embodiments of the present invention are therefore to be construed in all aspects as illustrative and not restrictive. The scope of the invention should be determined by the appended claims and their legal equivalents, not by the above description, and all changes coming within the meaning and equivalency range of the appended claims are intended to be embraced therein.

The invention claimed is:

1. A cleaner comprising:

a power input unit for receiving and outputting power;

a controller for selectively receiving power from the power input unit;

a power consumption unit controlled by the controller;

a manipulation unit for inputting a command for adjusting an operation state of the power consumption unit; and a power supply adjuster connected to the power input unit, the controller and the manipulation unit, wherein the power supply adjuster:

supplies power received from the power input unit to the controller and transmits a signal for the intensity of the suction force to the controller, in a state in which an intensity of suction force is selected by the manipulation unit, and interrupts supply of power received from the power input unit to the controller in a state in which an OFF command is input by the manipulation unit.

2. The cleaner according to claim 1, wherein any one of selection of the intensity of the suction force and input of the OFF command is selectively performed in the manipulation unit.

3. The cleaner according to claim 1, wherein the power supply adjuster includes a power switch connected to the power input unit and the manipulation unit.

4. The cleaner according to claim 3, wherein the power supply adjuster includes:

a first resistor connected to a first terminal and a control terminal of the power switch; and a second resistor connected to the control terminal of the power switch and one end of the manipulation unit.

5. The cleaner according to claim 4, wherein the manipulation unit includes a sliding member operating in a sliding manner, and wherein the power switch is maintained in an OFF state when the sliding member is moved to an OFF position and is maintained in an ON state when the sliding member is moved to an ON position.

6. The cleaner according to claim 5, further comprising a switch mode power supply (SMPS) connected to a second terminal of the power switch and the controller to supply a driving voltage to the controller.

7. The cleaner according to claim 5, further comprising a switch mode power supply (SMPS) connected to the first terminal of the power switch and the power input unit to supply a driving voltage to the controller.

8. The cleaner according to claim 4, wherein the manipulation unit includes:

an OFF button;

a selection button for inputting an operation command of the power consumption unit; and a tact switch capable of being turned on by selection of the OFF button and the selection button.

9. The cleaner according to claim 8, further comprising a protection circuit for maintaining the power switch in an ON state in a state of selecting the selection button.

10. The cleaner according to claim 9, wherein the protection circuit includes:

a resistor connected to the control terminal of the power switch; and a switch connected to the resistor and controlled by the controller.

11. The cleaner according to claim 10, wherein the resistor of the protection circuit is connected to the second resistor in parallel.

12. The cleaner according to claim 4, wherein the power supply adjuster includes:

a third resistor connected to the other end of the manipulation unit; and a fourth resistor connected to the third resistor in series and grounded, and wherein the controller is connected between the third resistor and the fourth resistor.

13. The cleaner according to claim 1, wherein the power input unit is a power cord connected to a commercial power supply.

14. The cleaner according to claim 1, wherein the power input unit is a battery capable of supplying power to the power consumption unit.

* * * * *